US006124071A

United States Patent [19]

Lin et al.

[11] Patent Number: 6,124,071

[45] Date of Patent: Sep. 26, 2000

[54] TONER COMPOSITIONS

[75] Inventors: Pinyen Lin, Rochester; Carol A. Fox, Canandaigua; Roger N. Ciccarelli, Rochester, all of N.Y.

[73] Assignee: Xerox Corporation, Stamford, Conn.

[21] Appl. No.: 09/258,916

[22] Filed: Mar. 1, 1999

[51] Int. Cl.[7] ..... G03G 9/097

[52] U.S. Cl. ..... 430/110; 430/903

[58] Field of Search ..... 430/110, 903, 430/106

[56] References Cited

U.S. PATENT DOCUMENTS

| | | | |
|---|---|---|---|
| 3,590,000 | 6/1971 | Palermiti et al. | 252/62.1 |
| 4,558,108 | 12/1985 | Alexandru et al. | 526/340 |
| 4,883,736 | 11/1989 | Hoffend et al. | 430/110 |
| 4,917,982 | 4/1990 | Tomono et al. | 430/99 |
| 4,921,771 | 5/1990 | Tomono et al. | 430/110 |
| 4,988,598 | 1/1991 | Tomono et al. | 430/99 |
| 4,997,739 | 3/1991 | Tomono et al. | 430/110 |
| 5,004,666 | 4/1991 | Tomono et al. | 430/110 |
| 5,023,158 | 6/1991 | Tomono et al. | 430/99 |
| 5,324,613 | 6/1994 | Ciccarelli et al. | 430/110 |
| 5,366,840 | 11/1994 | Larson et al. | 430/115 |
| 5,376,494 | 12/1994 | Mahabadi et al. | 430/137 |
| 5,645,965 | 7/1997 | Duff et al. | 430/59 |
| 5,672,456 | 9/1997 | Chamberlain et al. | 430/115 |
| 5,840,458 | 11/1998 | Kido et al. | 430/109 |
| 5,891,600 | 4/1999 | Okuno et al. | 430/110 |

*Primary Examiner*—John Goodrow
*Attorney, Agent, or Firm*—E. D. Palallo

[57] ABSTRACT

A toner comprised of polymer and titanium oxide dihydroxide of the formula —O—$Ti(OH)_2$ wherein Ti is titanium.

33 Claims, No Drawings

TONER COMPOSITIONS

RELATED PATENTS

Illustrated in U.S. Pat. No. 5,672,456, the disclosure of which is totally incorporated herein by reference, is a liquid developer with aluminum complex charge directors and which charge directors may be selected as charge additives for the toners of the present invention. Also, there can be more specifically selected for the toners of the present invention, Alohas an abbreviation for hydroxy bis(3,5-di-tertiary butyl salicylic) aluminate monohydrate, and related complexes, reference for example U.S. Pat. Nos. 5,366,840 and 5,324,613, the disclosures of which were totally incorporated herein by reference.

BACKGROUND OF THE INVENTION

This invention is generally directed to toner compositions, and more specifically, nonmagnetic single component toners containing titanium dihydroxide charge additives, such as those of aluminum complexes and metal oxide surface additives, and which toners can be selected for converting latent electrostatic images to visible images, which latent electrostatic images can be formed on a latent-electrostatic-image-bearing member and developed to visible images in a development zone where the latent-electrostatic-image-bearing member is positioned in the vicinity of a rotatable development roller which carries the nonmagnetic single component toner. The toners of the present invention, which can be selected for xerographic imaging and printing, and digital printing, possess a number of advantages inclusive of excellent stable toner charging minimal aging when in contact with toner dimer rolls, rapid admix charging, for example from about 5 to about 50 milliseconds, minimal toner adherence to charging blades, stable solid area densities of, for example, equal to or greater than 1.2, such as from about 1.2 to about 5, and high color gamut.

PRIOR ART

The electrophotographic process typically comprises the main steps of charging and discharging a photoreceptor, developing the resulting charged or discharged latent image, transferring the developed image to a substrate, which may be paper or a transparent film, cleaning the residual image off of the photoreceptor, and fusing the image that has been transferred to the substrate by heat, pressure or a combination of heat and pressure. When development is accomplished by a two component development system, the carrier beads assist in imparting a charge on the toner that is appropriate for the development of the latent image on the photoreceptor.

Two-component toners, however, have exhibited several disadvantages in that they involve relatively complicated machine construction and which machines are sometimes difficult to maintain. Furthermore, since a toner in a two-component developer system is triboelectrically charged by mutual friction with the carrier, the surface of the carrier can be contaminated with toner and/or the coating of carrier may chip off of the carrier surface after the two-component toner is used for a certain period of time. When this occurs, it can be difficult to apply sufficient triboelectric charge to the toner.

With regard to single component toners which are free of carrier beads, the charging of the toner relies on the relationship of the triboelectric charges generated and exchanged by contact of the toner with the donor roll and metering blade, thus has a promising potential avoiding many of the disadvantages that carrier contamination and the carrier coating deterioration.

Magnetic single component toners containing, for example, about 30 to about 60 percent by weight of magnetic powders may possess disadvantages in that the large amount of magnetic powder (30 to 60 percent by weight) reduces the toner electrical resistivity resulting in inferior image resolution and susceptibility to environmental changes. Further, magnetic toner powder can also adversely affect toner fusing. In addition, the natural color of the magnetic powder renders it difficult to obtain nonblack color toner.

Toners with negatively charge enhancing additives are known. However, some of these charge enhancing additives, such as a metal complex (T-77), negative charge control agent available from Hodogaya Chemical Corporation, are colored to an extent sufficient to shift the color gamut of certain dyes or pigments such that they are substantially unsuitable for use in xerographic devices that employ black and colored toners. Other negative charge enhancing additives like aluminum palmitates may plasticize the toner resin resulting in a lowering of the toner glass transition temperature and subsequently causing toner blocking during storage. Negatively charge enhancing additives, such as the zinc salts of salicylic acid from Oriental Company, initially provide acceptable triboelectrically charged toners, however, the charge is not stable and deteriorates during usage. Likewise, other copy quality attributes, such as clean background, substantially no smearing of the photoreceptor for a broad range of relative humidity conditions, that is for example from between about 20 to 90 percent relative humidity at, for example, temperature zones ranging, for example, from between about 20° C. to about 80° C., low machine dirt, and excellent solid area density are desirable toner attributes that not all negatively charge enhancing additives can provide.

SUMMARY OF THE INVENTION

It is, therefore, a feature of the present invention to provide an image forming system and a toner, which is substantially a nonmagnetic single component type developer.

Another feature of the present invention is to provide an image forming system equipped with a developing apparatus having an elastic blade for applying a developer containing a toner onto a developer-carrying member.

Another feature of the present invention is to provide a toner free from toner sticking or filming contamination on the surfaces of an elastic blade and the developer-carrying member even when a strong pressing force is exerted between them.

Further, another feature of the present invention is to provide an image forming system and a toner wherein the toner can be charged to 2 to 30 $\mu$c/gram within about 5 to about 35 milliseconds when the toner passes through the nip of an elastic blade and the toner-carrying members operating at, for example, a speed of about 60 to about 200 millimeters/second.

Moreover, another feature of the present invention is to provide a toner wherein the toner charge is stable, that is, the toner charge does not decline more than about 30 percent of the original charge on the toner-carrying member up to, for example, about 5 hours at zero toner throughput rate.

Another feature of the present invention is to provide an image forming system and a toner wherein the toner charge distribution on the toner-carrying member has a 30 to 50 percent narrower charge distribution measured by a charge spectrometer compared to other charging control agents.

Aspects of the present invention relate to a toner comprised of polymer and titanium oxide dihydroxide of the formula —O—-Ti(OH)$_2$ wherein Ti is titanium; a toner comprised of polymer, a charge control agent, a colorant, a wax, and titanium oxide dihydroxide, and wherein the titanium dihydroxide is of the formula —O—Ti(OH)$_2$ wherein Ti is titanium; a toner wherein the toner further contains a surface additive mixture comprised of from about 0.2 to about 4 weight percent in each instance of hydrophobic colloidal, fumed silica or metal oxide particles; a toner wherein the titanium oxide hydroxide is a primary particle size of about 30 nanometers; a toner wherein the titanium oxide hydroxide is of an aggregate size of about 300 nanometers; a toner wherein the titanium oxide hydroxide is blended on the toner surface in an amount of from about 0.3 to about 3 weight percent; a toner wherein a coating of an alkyl silane is present on the titanium oxide dihydroxide, and which coating is present in an amount of from about 10 to about 60 weight percent based on the hydroxide and the alkylsilane; a toner wherein the charge control agent provides a negative triboelectric charge on the toner; a set of toners wherein the colorant is cyan, magenta, yellow, black, or mixtures thereof; a toner wherein the charge control agent is an organic aluminum complex of the alternative formulas, or mixtures thereof

II.

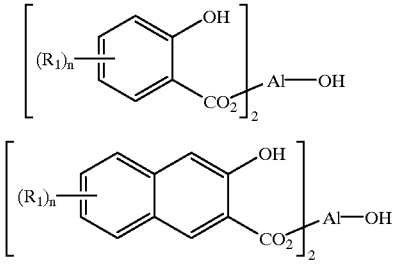

wherein $R_1$ is selected from the group consisting of hydrogen and alkyl, and n represents the number of $R_1$ segments; a toner wherein alkyl contains from 1 to about 25 carbon atoms, and n is a number of from 1 to 4; a toner wherein alkyl contains from 1 to about 10 carbon atoms, or about 1 to about 6 carbon atoms; a toner wherein the charge additive, or charge control agent is aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis [dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis [dialkylated hydroxy naphthoic acid] aluminate wherein alkyl contains 1 to about 6 carbon atoms; or bis[trialkylated hydroxy naphthoic acid] aluminate wherein alkyl contains 1 to about 6 carbon atoms; a toner wherein the charge control agent is hydroxy bis(3,5-di-tertiary butyl salicylic) aluminate monohydrate; a toner wherein the charge control agent is present in an amount of from about 0.01 to about 10 weight percent; a toner wherein the charge agent is present in an amount of from about 1 to about 5 weight percent; a toner wherein the polymer is present in an amount of from about 60 to about 95 weight percent, and wherein the total of all toner components is about 100 percent, or wherein the resin is present in an amount of from about 70 to about 90 weight percent and wherein the total of all toner components is about 100 percent; a toner wherein the colorant is present in an amount of from about 1 to about 20 weight percent and wherein the total of all toner components is about 100 percent; a toner wherein the colorant is present in an amount of from about 5 to about 15 weight percent and wherein the total of all toner components is about 100 percent; a toner wherein the colorant is carbon black; a toner wherein the colorant is red, blue, green or brown; a toner wherein the polymer is comprised of polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol, vinyl monomers of styrene, p-chlorostyrene, unsaturated mono-olefins of ethylene, propylene, butylene, isobutylene; saturated mono-olefins of vinyl acetate, vinyl propionate, and vinyl butyrate; vinyl esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide and mixtures thereof; styrene butadiene copolymers with an optional styrene content of from about 70 to about 95 weight percent, a styrene acrylate, a styrene methacrylate, a styrene-butadiene, a polyester, a reactive extruded polyester, or a hybrid polyester styrene/acrylate containing from about 0.1 percent to about 99.9 weight percent polyester and from about 99.9 percent to about 0.1 percent styrene/acrylate, and wherein the weight percent totals about 100 percent; a toner further wherein the wax is incorporated into the toner in an amount of from about 1 to about 10 weight percent; a toner wherein the wax is polypropylene, polyethylene, or mixtures thereof; a toner comprised of a binder, a charge control additive, colorant, wax, and a titanium oxide dihydroxide of the formula —O—Ti(OH)$_2$ wherein the charge control additive is an organic aluminum complex of the formulas, or mixtures thereof

II.

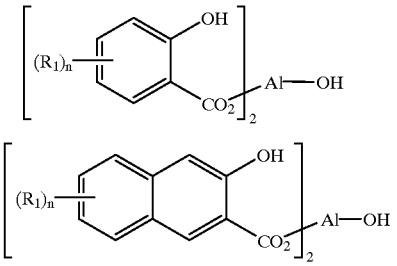

wherein $R_1$ is selected from the group consisting of hydrogen and alkyl, and n represents the number of R groups; a toner wherein $R_1$ is alkyl, and n is a number of 1 to 4; a toner wherein n is 1; and a toner further containing a toner surface additive.

The toner can be delivered to a developing zone in an imaging apparatus by a donor roll or a development sleeve which operates at a speed of, for example, from about 60 to 200 millimeters and preferably about 80 to about 150 millimeters per second. The development sleeve is usually hollow, approximately 8 to 15 inches in length, contains no magnets and is of a diameter of from about 10 to about 25 milliliters, and preferably from about 12 to about 20 millimeters. The hollow metal tube is usually coated with a metal, a metal oxide or a polymer with a coating thickness of from about 0.5 micron to about 30, and preferably from about 1 to about 10 microns. The thickness of the toner layer on the development sleeve can be controlled by an elastic blade comprised of an elastic plate formed, for example, of a rubber selected from the group consisting of urethane rubber, silicone rubber and nitrile-butadiene rubber, which may or may not be coated with a vinyl polymer, polyamide copolymer or silicone copolymer with a coating thickness of from about 0.5 micron to about 30, and preferably from about 1 to about 10 microns. The toner mass per unit area on the development sleeve is, for example, from about 0.6 to about 1.5 milligrams/$cm^2$. The triboelectrical charge, for example from about 5 to about 30 $\mu$c/gram, on the toner mass is of importance since if the charge is too low, excessive background will develop and if the charge is too high insufficient development of the image will result into proper development of the latent image, and which charge ranges from about 6 to about 15 microcoulombs/gram measured by a suction method.

The combination of a negatively charge enhancing agent, such as hydroxy bis(3,5-di-tertiary butyl salicylic) aluminate monohydrate, and the titanium dioxide or dihydroxyl titanium oxide surface additive, enables the toner delivered to the developing zone by the developing sleeve to rapidly charge in from about 5 milliseconds to about 50 milliseconds charge while maintaining a sharp, narrow charge distribution. Moreover, the toner triboelectric charge and distribution remains stable for at least 3,000 prints and in an optimized toner formulation for up to 10,000 prints. The charge stability can be determined using a bench fixture that operates the image forming system at a zero toner throughput rate. The toner charge remains stable for about 1 hour to about 5 hours.

In embodiments the present invention is directed to a single component nonmagnetic toner containing charge additives of the aluminum salts of alkylated salicylic acid like, for example, hydroxy bis[3,5-tertiary butyl salicylic] aluminate, or a mixture of the aluminum salts of alkylated salicylic acid like, for example, hydroxy bis[3,5-tertiary butyl salicylic] aluminate. The charge additives selected for the toners of the present invention are preferably represented by the following formulas, or mixtures thereof

II.

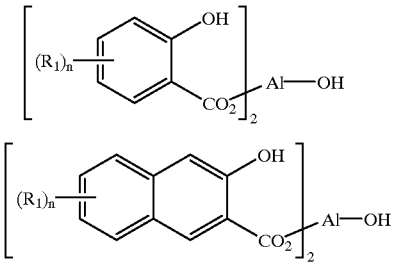

wherein $R_1$ is selected from the group consisting of hydrogen and alkyl, and n represents a number, such as from 1 to about 6.

Examples of the charge additives present in various effective amounts of, for example, from about 0.01 to about 10, and preferably from about 1 to about 5 weight percent or parts, include those as illustrated in U.S. Pat. No. 5,324,613, the disclosure of which is totally incorporated herein by reference, such as aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis [monoalkyl salicylic] aluminate; hydroxy bis[dialkyl salicylic] aluminate; hydroxy bis[trialkyl salicylic] aluminate; hydroxy bis[tetraalkyl salicylic] aluminate; hydroxy bis[hydroxy naphthoic acid] aluminate; hydroxy bis [monoalkylated hydroxy naphthoic acid] aluminate; bis [dialkylated hydroxy naphthoic acid] aluminate wherein alkyl preferably contains 1 to about 6 carbon atoms; bis [trialkylated hydroxy naphthoic acid] aluminate wherein alkyl preferably contains 1 to about 6 carbon atoms; bis [tetraalkylated hydroxy naphthoic acid] aluminate wherein alkyl preferably contains 1 to about 6 carbon atoms; and the like.

Various typical toner binders can be selected in suitable amounts, for example from about 60 to about 95 and preferably from about 70 to about 90 weight percent, or parts, and wherein the total of all toner components is about 100 percent, or 100 parts. Examples of toner resins are thermoplastics, such as polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol including a diol which may contain a diphenol group. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like, styrene butadiene copolymer with, for example, a styrene content of from about 70 to about 95 weight percent.

As one toner resin, there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers, such as Pliolites from Goodyear Tire and Rubber Company; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of terephthalic acid, or dimethylterephthalate, 1,3-butanediol, 1,2-propanediol, and pentaerythritol, reactive extruded polyesters, reference U.S. Pat. No. 5,376,494, the disclosure of which is totally incorporated herein by reference. Also, waxes with a low molecular weight, $M_w$, of, for example, from about 1,000 to about 20,000, such as polyethylene, polypropylene, and paraffin waxes, mixtures thereof, and the like, can be included in, or on the toner compositions as fuser roll release agents waxes, especially low molecular weight waxes present, for example, in an amount of from about 0.1 to about 5 weight percent are illustrated in U.S. Pat. Nos. 5,023,158; 5,004,666; 4,997,739; 4,988,598; 4,921,771 and 4,917,982, the disclosures of which are totally incorporated herein by reference.

The resin is present in a sufficient, but effective amount, for example from about 60 to about 90 weight percent. Thus, when 1 percent by weight of the charge enhancing additive is present, 10 percent by weight of pigment or colorant, and 1 percent by weight of titanium hydroxide is contained therein, about 88 percent by weight of resin is selected. Also, the charge enhancing additive of the present invention may be coated on the colorant. When used as a coating, the charge enhancing additive of the present invention is present in an amount of from about 0.1 weight percent to about 5 weight percent, and preferably from about 0.3 weight percent to about 1 weight percent.

Examples of the colorants include SUDAN BLUE OS, commercially available from BASF; NEOPAN BLUE, commercially available from BASF; PV FAST BLUE, commercially available from BASF; cyan, magenta, yellow, red, brown, blue or mixtures thereof, referenced from example U.S. Pat. No. 4,883,736, the disclosure of which is totally incorporated herein by reference. For the black toners, there can be selected a pigment such as carbon blacks like and including REGAL 330®, commercially available from Cabot Corporation, Raven 5750 from Columbia Chemical company, R5250 from Columbia Chemical Company and the like.

Examples of metal oxide toner surface additives are silicas, aluminum oxide, and titanium dioxide, each present in an amount of, for example, from about 0.1 to about 5 weight percent. Preferably the titanium hydroxide is present on the toner surface and when present in admixture with the aluminum complex charge control agents provides a number of advantages as indicated herein. The titanium hydroxide is available from Tayka Corporation, Titan Kogyo, and Degussa Chemicals, and is present in an amount of, for example, from about 0.1 to about 7 weight percent.

The toners of the present invention can be selected for imaging and printing methods wherein, for example, a latent image is formed on a photoconductive imaging member, reference for example selenium, selenium alloys, layered photoconductive imaging members, such as those illustrated in U.S. Pat. No. 4,265,990 and U.S. Pat. No. 5,645,965, the disclosures of which are totally incorporated herein by reference, and the like; followed by development with the toner of the present invention; transfer to a suitable substrate like paper; and fixing by heating or pressure or a combination of heat and pressure.

The following Examples are provided.

EXAMPLE I

There was prepared in an extrusion device, available from Werner Pfleiderer, a nonmagnetic toner composition, that is the toner is free of magnetite and the toner carrying member does not contain any magnets, by adding thereto 93 percent by weight of a crosslinked polyester resin (bisphenol A propylene oxide fumarate polymer with 2 to 15 percent gel), 3 percent by weight of Alohas an aluminum salt of alkylated salicylic acid; and 4 percent by weight of PV FAST BLUE™ pigment. After cooling, the extrudate was ground in a jet mill followed by classification to provide a blue toner having a volume average particle size of about 7 $\mu$m as measured by a Coulter Counter. The resulting toner was subsequently blended with a small-sized external additive mixture, surface-treated silica with a 12 nanometer particle size (TS-720®, from Cabosil Corporation), and 1.0 percent by weight of a surface-treated titania (titanium oxide hydroxide, $TiO(OH)_2$) with a 30 nanometer particle size (available as STT100H™ from Titan Kogyo).

Subsequently, the above formulated toner was loaded in a toner cartridge for printing test in an APPLE® Laserwriter 12/600™ printer. The printing test was conducted in a continuous mode and the average area coverage of the prints was about 6 percent. Totally about 5,000 sheets of prints were accomplished in each printing test. The print quality, such as solid area density, was measured by a reflective densitometer at the beginning and the end of the printing tests. The solid area density, the triboelectric toner charge, and stability of the solid area density were excellent compared to a similar toner with no titanium oxide surface additives, see the Table that follows.

The triboelectric charge of the toner on the toner-carrying member was measured at −11.5 microcoulombs per gram and −8.9 microcoulombs per gram at initial, that is the first copy and at 5,000 prints respectively using a Solid State Electrometer (Model 610C obtained from Keithley Instruments). The initial charge of the toner was 20 percent to 50 percent higher than the charge of the following Comparative Example toners and the charge at 5,000 prints was 3 to 18 times higher than the charge of the Comparative Example toners. A charge spectrograph analysis of the toner, measured at 100 volts/centimeter, resulted in 4.8 millimeters of total charge distribution. The charge spectrum width of the above prepared toner was about 25 percent to about 32 percent narrower than those of the Comparative Examples. The printing test results and the charge properties are illustrated in Table 2.

EXAMPLE II

In accordance with Example I, there was prepared in an extrusion device, available from Werner Pfleiderer, a toner composition by adding thereto 92 percent by weight of a crosslinked polyester resin (bisphenol A propylene oxide fumarate polymer with 2 to 15 percent gel), 4 percent by weight of Alohas, an aluminum salt of an alkylated salicylic acid and 4 percent by weight of PV FAST BLUE™ pigment. Thereafter, the toner was blended with the surface additives of Example I.

Subsequently, the above formulated toner was loaded in a toner cartridge for printing test in an APPLE® Laserwriter 12/600™ printer. The printing test was conducted as described in Example I. The solid area density for initial and 5,000 prints were 1.55 and 1.52, respectively. The stability of the solid area density was excellent compared to the toners without titanium oxide surface additives of the Comparative Examples.

The triboelectric charge of the toner on the toner-carrying member was measured at −12.5 microcoulombs per gram and −9.1 microcoulombs per gram at the first print and at 5,000 prints, respectively, using a Solid State Electrometer (Model 610C obtained from Keithley Instruments). The initial charge of the toner was 20 percent to 50 percent higher than the charge of the toner of the Comparative Examples, and the charge at 5,000 prints was 3 to 18 times higher than the charge of the toner of the Comparative Examples. A charge spectrograph analysis of the toner, measured at 100 volts/centimeter, resulted in 5.2 millimeters of total charge distribution. The charge spectrum width of the prepared toner was about 25 percent to about 32 percent narrower than those of the Comparative Examples. The printing test results and the charge properties are shown in Table 2.

EXAMPLE III

There was prepared in an extrusion device, available from Werner Pfleiderer, a toner composition by adding thereto 91 percent by weight of a crosslinked polyester resin (bisphenol A propylene oxide fumarate polymer with 2 to 15 percent gel), 5 percent by weight of the aluminum salts of alkylated salicylic acid; and 4 percent by weight of PV FAST BLUE™ pigment. The toner was then blended with the surface additives of Example I.

Subsequently, the above formulated toner was loaded in a toner cartridge for printing test in an APPLE® Laserwriter 12/600™ printer. The printing test was conducted as described in Example I. The solid area density for initial and 5,000 prints were 1.45 and 1.5, respectively.

The triboelectric charge of the toner on the toner-carrying member was measured at −13.7 microcoulombs per gram and −9.3 microcoulombs per gram at initial and at 5,000 prints using a Solid State Electrometer (Model 610C obtained from Keithley Instruments). A charge spectrograph analysis of the toner, measured at 100 volts/centimeter, resulted in 5.0 millimeters of total charge distribution. The printing test results and the charge properties are shown in Table 2.

EXAMPLE IV

There was prepared in an extrusion device, available from Werner Pfleiderer, a toner composition by adding thereto 92 percent by weight of a crosslinked polyester resin (bisphenol A propylene oxide fumarate polymer with 2 to 15 percent gel), 4 percent by weight of Alohas; and 4 percent by weight of PV FAST BLUE™ pigment. The grinding and classification process was the same as that in Example I. After cooling, the extrudate was ground in a jet mill followed by classification to prepare a blue toner having a volume average particle size of 7 μm as measured by a Coulter Counter. The resulting toner was subsequently blended with an external additive package consisting of 1.5 percent by weight of a surface-treated silica with a 12 nanometer particle size (TS-720, from Cabosil Corporation), and 1.0 percent by weight of a surface-treated titania (titanium oxide hydroxide, $TiO(OH)_2$) with a 30 nanometer particle size (STT100H™, from Titan Kogyo).

Subsequently, the above formulated toner was loaded in a toner cartridge for printing test in an APPLE® Laserwriter 12/600™ printer. The printing test was conducted as described in Example I. The solid area density for initial and 5,000 prints was 1.56 and 1.43, respectively.

The triboelectric charge of the toner on the toner-carrying member was measured at −12.2 microcoulombs per gram and −8.5 microcoulombs per gram at initial and at 5,000 prints using a Solid State Electrometer (Model 610C obtained from Keithley Instruments). A charge spectrograph analysis of the toner, measured at 100 volts/centimeter, resulted in 4.3 millimeters of total charge distribution. The printing test results and the charge properties are shown in Table 2.

EXAMPLE V

There was prepared in an extrusion device, available from Werner Pfleiderer, a toner composition by adding thereto 92 percent by weight of a styrene-butadiene copolymer (91 weight percent of styrene, 9 weight percent of butadiene), 4 percent by weight of Alohas; and 4 percent by weight of PV FAST BLUE™ pigment. After cooling, the extrudate was ground in a jet mill followed by classification to prepare a blue toner having a volume average particle size of 7 μm as measured by a Coulter Counter. The resulting toner was subsequently blended with a small-sized external additive package consisting of 1.5 percent by weight of a surface-treated silica with an 12 nanometer particle size (TS-720, from Cabosil Corporation), and 1.0 percent by weight of a surface-treated titania (titanium oxide hydroxide, $TiO(OH)_2$) with a 30 nanometer particle size (STT100H™, from Titan Kogyo).

Subsequently, the above formulated toner was loaded in a toner cartridge for printing test in an APPLE® Laserwriter 12/600™ printer. The printing test was conducted as described in Example I. The solid area density for initial and 5,000 prints was 1.6 and 1.45, respectively.

The triboelectric charge of the above prepared toner on the toner-carrying member was measured at −12.0 microcoulombs per gram and −8.0 microcoulombs per gram at initial and at 5,000 prints using a Solid State Electrometer (Model 610C obtained from Keithley Instruments). A charge spectrograph analysis of the toner, measured at 100 volts/centimeter, resulted in 5.5 millimeters of total charge distribution. The printing test results and the charge properties are illustrated in Table 2.

EXAMPLE VI

There was prepared in an extrusion device, available from Werner Pfleiderer, a toner composition by adding thereto 93 percent by weight of a styrene-acrylate copolymer (58 percent by weight of styrene, 42 percent of n-butyl methacrylate, with a melt index of 16 measured by ASTM D123A), 5 percent by weight of the Alohas; and 2 percent by weight of PV FAST BLUE™ pigment. After cooling, the extrudate was ground in a jet mill followed by classification to prepare a blue toner having a volume average particle size of 7 μm as measured by a Coulter Counter. The resulting toner was subsequently blended with a small-sized external additive package consisting of 1.5 percent by weight of a surface-treated silica with an 12 nanometer particle size (TS-720 from Cabosil Corporation), and 1.0 percent by weight of a surface-treated titania (titanium oxide hydroxide, $TiO(OH)_2$) with a 30 nanometer particle size (STT100H, from Titan Kogyo). The toner compositions are shown in Table 1.

Subsequently, the above formulated toner was loaded in a toner cartridge for printing test in an APPLE® Laserwriter 12/600™ printer. The printing test was conducted as described in Example I. The solid area density for initial and 5,000 prints was 1.56 and 1.544, respectively.

The triboelectric charge of the above prepared toner on the toner-carrying member was measured at −13.0 microcoulombs per gram and −9.0 microcoulombs per gram at initial and at 5,000 prints using a Solid State Electrometer (Model 610C obtained from Keithley Instruments). A charge spectrograph analysis of the toner, measured at 100 volts/centimeter, resulted in 5.0 millimeters of total charge distribution. The printing test results and the charge properties are illustrated in Table 2.

COMPARATIVE EXAMPLE 1

There was prepared in an extrusion device, available from Werner Pfleiderer, a toner composition by adding thereto 92 percent by weight of a crosslinked polyester resin (bisphenol A propylene oxide fumarate polymer with 2 to 15 percent gel), 4 percent by weight of the charge control agent E84™, a zinc salt of salicylic acid obtained from Orient Company; and 4 percent by weight of PV FAST BLUE™ pigment. After cooling, the extrudate was ground in a jet mill followed by classification to provide a blue toner with a volume average particle size of about 7 μm as measured by a Coulter Counter. The resulting toner was subsequently blended with a small-sized external additive package of 1.5 percent by weight of surface-treated silica with a 12 nanometer particle size (TS-720®, from Cabosil Corporation), and 1.0 percent by weight of a surface-treated titania (titanium oxide hydroxide, $TiO(OH)_2$) with a 30 nanometer particle size (STT100H™, from Titan Kogyo).

Subsequently, the above formulated toner was loaded in a toner cartridge for printing test in an APPLE® Laserwriter 12/600™ printer. The printing test was conducted in a continuous mode and the average area coverage of the prints was about 6 percent. Totally, about 5,000 sheets of prints were accomplished in each printing test. The print quality, such as solid area density, was measured by a reflective densitometer at the beginning and the end of the printing tests. The solid area density for the initial and 5,000 prints was 1.4 and 0.6, respectively. The stability of the solid area density was poor because it drops from 1.4 to 0.6 compared to the toner of Examples I to VI.

The triboelectric charge of the toner on the toner-carrying member was measured at −8.0 microcoulombs per gram and −1.2 microcoulombs per gram at initial and at 5,000 prints using a Solid State Electrometer (Model 610C obtained from Keithley Instruments). The triboelectric charge was not stable, that is it decreased from −8.0 microcoulombs per gram to −1.2 microcoulombs per gram at initial and at 5,000 prints. A charge spectrograph analysis of the toner, measured at 100 volts/centimeter, resulted in 6.5 millimeters of total charge distribution. This charge distribution is broader than the toner in Examples I to VI. The printing test results and the charge properties are illustrated in Table 2.

COMPARATIVE EXAMPLE 2

There was prepared in an extrusion device, available from Werner Pfleiderer, a toner composition by adding thereto 92 percent by weight of a crosslinked polyester resin (bisphenol A propylene oxide fumarate polymer with 2 to 15 percent gel), 4 percent by weight of charge control agent E88™, from Orient Company; and 4 percent by weight of PV FAST BLUE™ pigment. After cooling, the extrudate was ground in a jet mill followed by classification to prepare a blue toner having a volume average particle size of about 7 μm as measured by a Coulter Counter. The resulting toner was subsequently blended with a small-sized external additive package consisting of 1.5 percent by weight of a surface-treated silica with a 12 nanometer particle size (TS-720®, from Cabosil Corporation), 1.0 percent by weight of a surface-treated titania (titanium oxide hydroxide, $TiO(OH)_2$) with a 30 nanometer particle size (STT100H™, from Titan Kogyo).

Subsequently, the above formulated toner was loaded in a toner cartridge for printing test in an APPLE® Laserwriter 12/600™ printer. The printing test was conducted in a continuous mode and the average area coverage of the prints was about 6 percent. The print quality, such as solid area density, was measured by a reflective densitometer at the beginning and the end of the printing tests. The solid area density for initial and 5,000 prints was 1.38 and 0.5, respectively. The stability of the solid area density decreased from 1.38 to 0.5.

The triboelectric charge of the toner on the toner-carrying member was measured at −6.5 microcoulombs per gram and −0.5 microcoulombs per gram at initial and at 5,000 prints, respectively, using a Solid State Electrometer (Model 610C obtained from Keithley Instruments). A charge spectrograph analysis of the toner, measured at 100 volts/centimeter, resulted in 6.7 millimeters of total charge distribution. The printing test results and the charge properties are illustrated in Table 2.

COMPARATIVE EXAMPLE 3

There was prepared in an extrusion device, available from Werner Pfleiderer, a toner composition by adding thereto 92 percent by weight of a crosslinked polyester resin (bisphenol A propylene oxide fumarate polymer with 2 to 15 percent gel), 4 percent by weight of Alohas; and 4 percent by weight of PV FAST BLUE™ pigment. The grinding and classification process was the same as that in Example I. After cooling, the extrudate was ground in a jet mill followed by classification to provide a blue toner having a volume average particle size of 7 μm as measured by a Coulter Counter. The resulting toner was subsequently blended with a small-sized external additive package of 1.5 percent by weight of a surface-treated silica with a 12 nanometer particle size (TS-720, from Cabosil Corporation), 1.0 percent by weight of a surface-treated titanium oxide with a 20 nanometer particle size (P25™, from Degussa Chemicals).

Subsequently, the above formulated toner,was loaded in a toner cartridge for printing test in an APPLE® Laserwriter 12/600™ printer. The printing test was conducted as described in Example I. The solid area density for initial and 5,000 prints was 1.4 and 0.9, respectively.

The triboelectric charge of the toner on the toner-carrying member was measured at −10.0 microcoulombs per gram and −3.5 microcoulombs per gram at initial and at 5,000 prints using a Solid State Electrometer (Model 610C obtained from Keithley Instruments). A charge spectrograph analysis of the toner, measured at 100 volts/centimeter, resulted in 7.0 millimeters of total charge distribution. The printing test results and the charge properties were shown in Table 2.

COMPARATIVE EXAMPLE 4

There was prepared in an extrusion device, available from Werner Pfleiderer, a toner composition by adding thereto 92 percent by weight of a crosslinked polyester resin (bisphenol A propylene oxide fumarate polymer with 2 to 15 percent gel), 4 percent by weight of charge control agent E84™, a zinc salt of salicylic acid obtained from Orient Company; and 4 percent by weight of PV FAST BLUE™ pigment. After cooling, the extrudate was ground in a jet mill followed by classification to prepare a blue toner having a volume average particle size of about 7 μm as measured by a Coulter Counter. The resulting toner was subsequently blended with a small-sized external additive package, 1.5 percent by weight of a surface-treated silica with a 12 nanometer particle size (TS-720® from Cabosil Corporation), and 1.0 percent by weight of a surface-treated titania from a composition mainly composed of $TiO_2$ and $Ti(OR)_m(OH)_n$ (m+n=4 and R is isopropyl) component 28 nanometers in diameter. It is believed that the toner tribo stability will be lower than that of Example I since the Ti(OR) chemical bond is unstable. The triboelectric charge and charge distribution for the prepared toner is also expected to be low and wide, respectively, because of the polarity of the isopropoxide group.

When the above toner was subsequently loaded in a toner cartridge for print testing in an APPLE® Laserwriter 12/600™ printer and wherein the printing test was conducted in a continuous mode with an average area coverage of the prints of about 6 percent, wherein a total of about 5,000 sheets of prints were accomplished in each printing test with the print quality, such as solid area density as measured by a reflective densitometer at the beginning and the end of the printing tests, the solid area density for each of the initial 5,000 prints decreased from 1.2 and 0.8, respectively. The stability of the solid area density was poor, that is it decreased from 1.2 to 0.8.

The triboelectric charge of the toner on the toner-carrying member was expected to be about −10 microcoulombs per gram and −5 microcoulombs per gram at initial, that is the first copy, and at 5,000 prints, respectively, using a Solid State Electrometer (Model 610C obtained from Keithley Instruments). The triboelectric charge was not stable since it would be decreased from −10 microcoulombs per gram to −5 microcoulombs per gram at initial and at 5,000 prints. A charge spectrograph analysis of the toner, measured at 100 volts/centimeter, was expected to result in a broad charge distribution.

Other embodiments and modifications of the present invention may occur to those of ordinary skill in the art subsequent to a review of the information presented herein; these embodiments and modifications, as well as equivalents thereof, were also included within the scope of the present invention.

TABLE 1

| | Toner Composition (part) | | | | | Surface Additive | |
|---|---|---|---|---|---|---|---|
| Example No. | Polyester | Styrene-butadiene | Styrene-acrylate | Pigment | CCA | Silica (TS720) | Titanium Oxide |
| Example I | 93 | | | 4 | 3 (Al salts of salicylic acid) | 1.5 | 1.0 (STT100H) |
| Example II | 92 | | | 4 | 4 (Al salts of salicylic acid) | 1.5 | 1.0 (STT100H) |
| Example III | 91 | | | 4 | 5 (Al salts of salicylic acid) | 1.5 | 1.0 (STT100H) |
| Example IV | 92 | | | 4 | 4 (Al salts of salicylic acid) | 1.5 | 1.0 (STT100H) |
| Example V | | 92 | | 4 | 4 (Al salts of salicylic acid) | 1.5 | 1.0 (STT100H) |
| Example VI | | | 92 | 4 | 4 (Al salts of salicylic acid) | 1.5 | 1.0 (STT100H) |
| Comparative Ex. 1 | 92 | | | 4 | 4 (E84 ™) | 1.5 | 1.0 (STT100H) |
| Comparative Ex. 2 | 2 | | | | 4 (E88 ™) | 1.5 | 1.0 (STT100H) |
| Comparative Ex. 3 | 92 | | | | 4 (Al salts of salicylic acid) | 1.5 | 1.0 (P25) |

TABLE 2

| | Triboelectric charge (μC/g) | | Solid Area Density | | Charge Spectrum Width (mm) |
|---|---|---|---|---|---|
| Example No. | Initial | 5000 prints | Initial | 5000 prints | Initial |
| Example I | −11.5 | −8.9 | 1.5 | 1.56 | 4.8 |
| Example II | −12.5 | −9.1 | 1.55 | 1.52 | 5.2 |
| Example III | −13.7 | −9.3 | 1.45 | 1.50 | 5.0 |
| Example IV | −12.2 | −8.5 | 1.56 | 1.43 | 4.3 |
| Example V | −12.0 | −8.0 | 1.60 | 1.45 | 5.5 |
| Example VI | −13.0 | −9.0 | 1.56 | 1.44 | 5.0 |
| Comparative Ex. 1 | −8.0 | −1.2 | 1.40 | 0.60 | 6.5 |
| Comparative Ex. 2 | −6.5 | −0.5 | 1.38 | 0.50 | 6.7 |
| Comparative Ex. 3 | −10.0 | −3.5 | 1.40 | 0.90 | 7.0 |

What is claimed is:

1. A toner comprised of polymer and titanium oxide dihydroxide of the formula —O—Ti(OH)$_2$ wherein Ti is titanium.

2. A toner comprised of polymer, a charge control agent, a colorant, a wax, and titanium oxide dihydroxide, and wherein said titanium dihydroxide is of the formula —O—Ti(OH)$_2$ wherein Ti is titanium.

3. A toner in accordance with claim 2 wherein said toner further contains a surface additive mixture comprised of from about 0.2 to about 4 weight percent in each instance of hydrophobic colloidal, fumed silica or metal oxide particles.

4. A toner in accordance with claim 2 wherein said titanium oxide hydroxide is a primary particle size of about 30 nanometers.

5. A toner in accordance with claim 2 wherein said titanium oxide hydroxide is of an aggregate size of about 300 nanometers.

6. A toner in accordance with claim 2 wherein said titanium oxide hydroxide is blended on the toner surface in an amount of from about 0.3 to about 3 weight percent.

7. A toner in accordance with claim 2 wherein a coating of an alkyl silane is present on said titanium oxide dihydroxide, and which coating is present in an amount of from about 10 to about 60 weight percent based on said hydroxide and said alkylsilane.

8. A toner in accordance with claim 2 wherein the charge control agent provides a negative triboelectric charge on said toner.

9. A set of toners in accordance with claim 2 wherein the colorant is cyan, magenta, yellow, black, or mixtures thereof.

10. A toner in accordance with claim 2 wherein the charge control agent is an organic aluminum complex of the alternative formulas, or mixtures thereof

II.

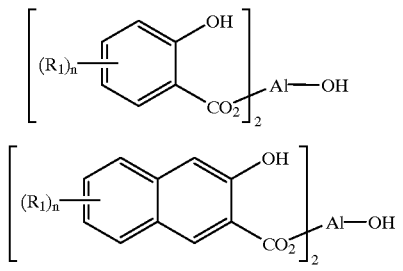

wherein $R_1$ is selected from the group consisting of hydrogen and alkyl, and n represents the number of $R_1$ segments.

11. A toner in accordance with claim 10 wherein alkyl contains from 1 to about 25 carbon atoms, and n is a number of from 1 to 4.

12. A toner in accordance with claim 10 wherein alkyl contains from 1 to about 10 carbon atoms, or about 1 to about 6 carbon atoms.

13. A toner in accordance with claim 2 wherein the charge additive, or charge control agent is aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis[dialkyl salicylic] aluminate; hydroxy bis [trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl contains 1 to about 6 carbon atoms; or bis[trialkylated hydroxy naphthoic acid] aluminate wherein alkyl contains 1 to about 6 carbon atoms.

14. A toner in accordance with claim 2 wherein the charge control agent is hydroxy bis(3,5-di-tertiary butyl salicylic) aluminate monohydrate.

15. A toner in accordance with claim 2 wherein the charge control agent is present in an amount of from about 0.01 to about 10 weight percent.

16. A toner in accordance with claim 2 wherein the charge agent is present in an amount of from about 1 to about 5 weight percent.

17. A toner in accordance with claim 2 wherein the polymer is present in an amount of from about 60 to about 95 weight percent, and wherein the total of all toner components is about 100 percent, or wherein the resin is present in an amount of from about 70 to about 90 weight percent and wherein the total of all toner components is about 100 percent.

18. A toner in accordance with claim 2 wherein the colorant is present in an amount of from about 1 to about 20 weight percent and wherein the total of all toner components is about 100 percent.

19. A toner in accordance with claim 2 wherein the colorant is present in an amount of from about 5 to about 15 weight percent and wherein the total of all toner components is about 100 percent.

20. A toner in accordance with claim 2 wherein the colorant is carbon black.

21. A toner in accordance with claim 2 wherein the colorant is red, blue, green or brown.

22. A toner in accordance with claim 2 wherein the polymer is comprised of polyamides, polyolefins, styrene acrylates, styrene methacrylates, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol, vinyl monomers of styrene, p-chlorostyrene, unsaturated mono-olefins of ethylene, propylene, butylene, isobutylene; saturated mono-olefins of vinyl acetate, vinyl propionate, and vinyl butyrate; vinyl esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide and mixtures thereof; styrene butadiene copolymers with an optional styrene content of from about 70 to about 95 weight percent, a styrene acrylate, a styrene methacrylate, a styrene-butadiene, a polyester, a reactive extruded polyester, or a hybrid polyester styrene/acrylate containing from about 0.1 percent to about 99.9 weight percent polyester and from about 99.9 percent to about 0.1 percent styrene/acrylate, and wherein said weight percent totals about 100 percent.

23. A toner in accordance with claim 2 further wherein said wax is incorporated into said toner in an amount of from about 1 to about 10 weight percent.

24. A toner in accordance with claim 23 wherein said wax is polypropylene, polyethylene, or mixtures thereof.

25. A toner comprised of a binder, a charge control additive, colorant, wax, and a titanium oxide dihydroxide of the formula —O—Ti$(OH)_2$ wherein said charge control additive is an organic aluminum complex of the formulas, or mixtures thereof

II.

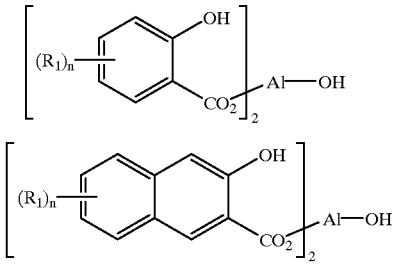

wherein $R_1$ is selected from the group consisting of hydrogen and alkyl, and n represents the number of R groups.

26. A toner in accordance with claim 25 wherein $R_1$ is alkyl, and n is a number of 1 to 4.

27. A toner in accordance with claim 25 wherein n is 1.

28. A toner in accordance with claim 2 further containing a toner surface additive.

29. A toner consisting essentially of polymer and titanium oxide dihydroxide of the formula —$[O—Ti(OH)_2]_n$— wherein Ti is titanium and wherein n represents the number of segments.

30. A toner in accordance with claim 1 wherein said polymer is a styrene acrylate, a styrene methacrylate, a styrene butadiene, or a polyester.

31. A toner in accordance with claim 1 wherein said titanium oxide dihydroxide contains a coating of an alkyl silane.

32. A toner in accordance with claim 2 wherein said titanium oxide dihydroxide contains a coating of an alkyl silane.

33. A toner in accordance with claim 1 wherein said titanium oxide dihydroxide is surface treated.

* * * * *